United States Patent [19]

Carbonneau

[11] 3,953,687

[45] Apr. 27, 1976

[54] MAGNETIC STRUCTURE FOR MOVING VOICE COIL LOUDSPEAKER

[75] Inventor: Gordon S. Carbonneau, Grand Rapids, Mich.

[73] Assignee: Carbonneau Industries, Inc., Grand Rapids, Mich.

[22] Filed: Nov. 29, 1974

[21] Appl. No.: 528,467

Related U.S. Application Data

[63] Continuation of Ser. No. 412,554, Nov. 5, 1973, abandoned.

[52] U.S. Cl. ..... 179/115.5 R; 179/119 R

[51] Int. Cl.[2] ..... H04R 9/02

[58] Field of Search ..... 179/115.5 R, 115.5 PC, 179/115.5 SF, 117, 119 R, 120; 335/231

[56] References Cited

UNITED STATES PATENTS

| | | | |
|---|---|---|---|
| 1,795,948 | 3/1931 | High | 179/119 R |
| 2,556,816 | 6/1951 | Lukacs | 179/115.5 R |
| 3,296,386 | 1/1967 | Fanselow | 179/120 |
| 3,453,400 | 7/1969 | Coen | 179/119 R |
| 3,593,239 | 7/1971 | Hofman | 335/231 |

FOREIGN PATENTS OR APPLICATIONS

| | | | |
|---|---|---|---|
| 1,361,069 | 4/1964 | France | 335/231 |
| 858,087 | 11/1940 | France | 179/115.5 R |

*Primary Examiner*—Kathleen H. Claffy
*Assistant Examiner*—George G. Stellar
*Attorney, Agent, or Firm*—Austin A. Webb

[57] ABSTRACT

A loudspeaker magnet structure has a flat annular, torus shaped, permanent magnet with a central cylindrical pole piece of magnetically conductive material extending coaxially through the magnet. A back plate of magnetically conductive material is lapped across the rear side of the magnet and engaged around or over the rear end of the pole piece. A front plate of magnetically conductive material is lapped against the front surface of the magnet and has a central hole of greater diameter than the diameter of the pole piece surrounding the front end of the pole piece.

The front surface of the front plate tapers rearwardly to the rear surface of the front plate in continuously decreasing thickness from adjacent to the central hole to closely adjacent to the outer edge of the magnet. The rear surface of the rear plate tapers rearwardly in constantly increasing thickness from closely adjacent to the outer edge of the magnet to a central portion of constant thickness having a diameter approximately equal to the diameter of the cylindrical pole piece.

3 Claims, 7 Drawing Figures

MAGNETIC STRUCTURE FOR MOVING VOICE COIL LOUDSPEAKER

This is a continuation of application Ser. No. 412,554, filed 5 Nov. 1973 now abandoned.

OUTLINE OF INVENTION

Similar magnetic structures in which the permanent magnet, known as a ceramic magnet, consists of a ring of powdered iron compressed with a suitable binder have used steel or iron end plates of generally constant thickness and a central cylindrical pole piece of steel or iron. The end plates have uniformly been of somewhat lesser diameter than the permanent magnet, leaving a narrow annular rim of one-sixteenth of an inch, or more, of the magnet exposed around the end plates. This extension of the magnet beyond the edges of the end plates has been to reduce leakage of magnetic flux between the radially outer edge surfaces of the plates.

The present invention has several structural changes, each of which cooperate to make several additive improvements in the overall operation of the magnet structure. The diameter of the central cylindrical pole piece is determinative of the size of the magnet structure. That is, the diameter of the center pole piece is preselected to cooperate with a voice coil of a known or given size. Thus, the diameter of the pole piece is considered as fixed in comparing the magnet structure of the present invention with prior magnetic structures.

By tapering the outer end surfaces of the end plates to practically zero thickness at the outer edges, the present invention reduces the polarized annular outer edges of the plates to practically zero area. This reduces leakage flux between the outer edges of the end plates. Next, by thus reducing the exposed outer edges of the end plates, and the tendency for magnetic leakage therebetween, it becomes unnecessary to leave the prior radial projection of the magnet beyond the edges of the end plates. As a result, the diameter of the end plates can be increased, or the outer diameter of the magnet (and the amount of magnetic material) can be reduced. Given a desire to maintain at least the same flux density of the old magnet assembly, the new structure will be described as having a new magnet of reduced diameter.

Since the ceramic magnetic material is relatively expensive, the reduction of the outer diameter of the magnet results in a significant reduction in both the cost and weight of the magnet. While the cost of the iron or steel in the end plates is small relative to the cost of the magnet, the weight of the end plates is considerable. Tapering the thickness of the end plates can more than halve their weight. This results not only in a material cost saving, but also in a significant reduction in the cost of shipping and handling both the parts and the finished magnetic structures and loudspeakers made therefrom.

Further advantages and economies of manufacture can be achieved by utilizing the tapered shape of the end plates. The tapered shape is easily achieved by press molding and sintering powered metal, or by die forging segments of inexpensive iron wire. Both methods eliminate practically all waste of material, as will be described.

DESCRIPTION

The drawings of which there are two sheets illustrate a preferred form of the magnet structure as incorporated in a loudspeaker and two methods of building or assembly thereof.

Figure 1:
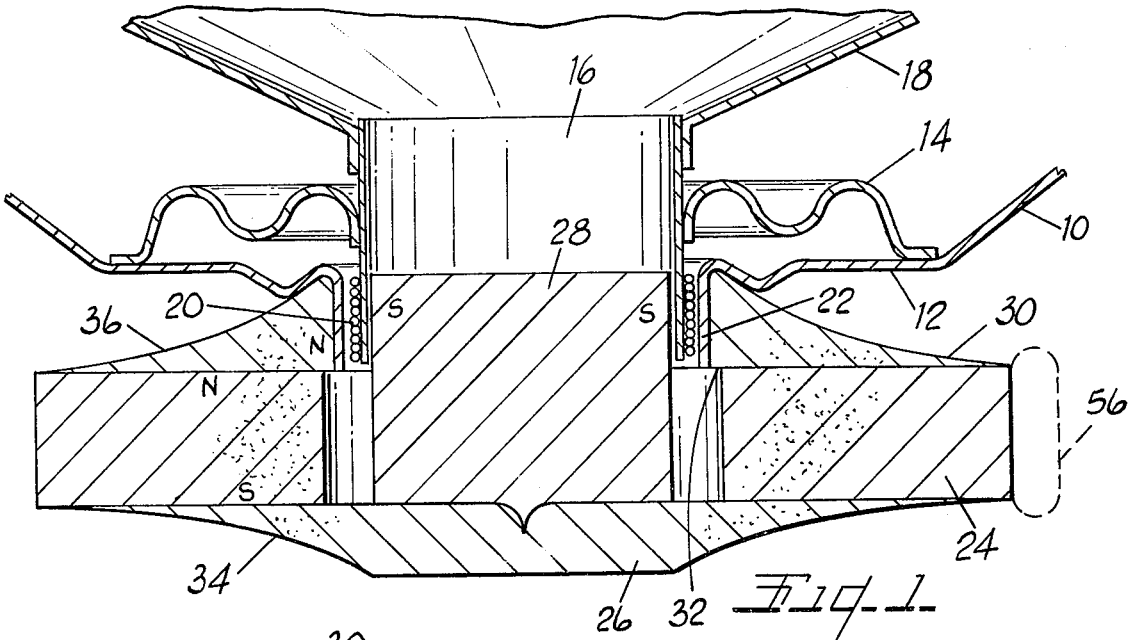
FIG. 1 is an axial cross sectional view through a portion of a loudspeaker and the coacting magnetic structure thereof assembled according to the invention.
Figure 2:
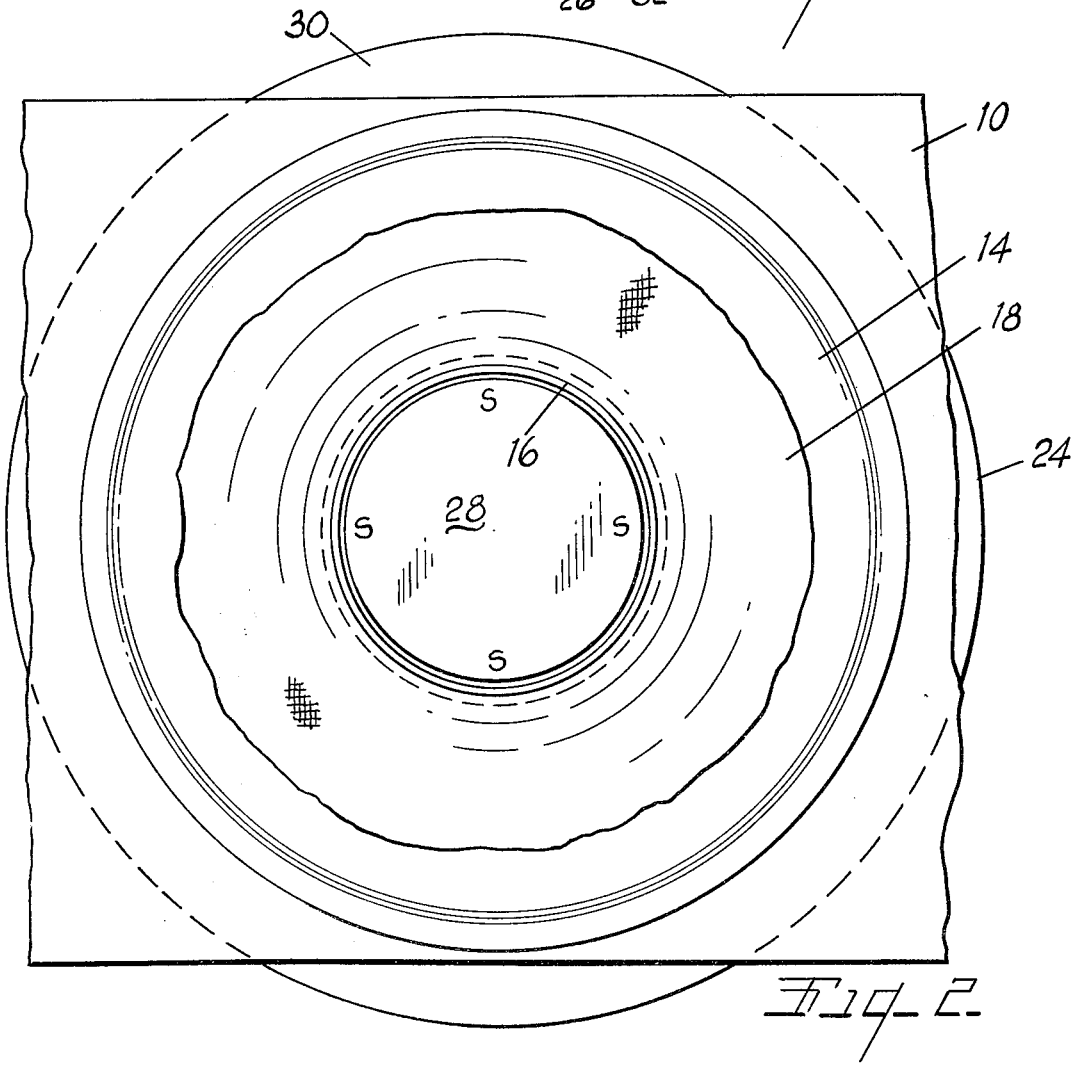
FIG. 2 is a fragmentary top plan view of the speaker and magnet parts shown in FIG. 1.
Figure 4:
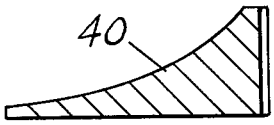
FIG. 4 is a cross sectional view along the line 4—4 in FIG. 3.

The example of the magnetic structure and loudspeaker shown in FIGS. 1 and 2 conventionally illustrates a "basket" or frame 10 of stamped sheet metal. The basket has a flat annular central area 12 to which is secured the outer rim or periphery of an annular flexible spider 14. The center of the spider guidingly supports the voice coil tube 16, which is in turn connected to the apex of the speaker cone or diaphragm 18. The voice coil winding 20 on the lower end of tube 16 reciprocates in close clearing relation within the magnetic field developed in this case within a short cylindrical eyelet 22 pressed down from the center of the basket.

The source and path of the magnetic field is created by a flat annular permanent magnet 24 made up of fine particles of iron oriented or polarized in a ceramic binder. Such magnets are well known and are sometimes referred to as ceramic magnets. From the bottom or rear face of the magnet labeled S the magnetic flux lines are picked up and directed radially inwardly by a rear end plate 26. The path of flux continues to the bottom of a cylindrical iron or steel center pole piece 28 and up the pole piece to where it projects into the voice coil tube and the coil 20 and forms an S pole in spaced opposed relation to the eyelet 22. Magnetic flux from the top N pole of the magnet is collected and transmitted to the eyelet 22 by a top or outer end plate 30. This general arrangement of ceramic magnet, end plates and center pole piece is old. The invention lies in the shape of the end plates as will be described. The eyelet 22 may be omitted if other means of mounting are provided; in which case the radially inward projection of the outer end plate over the edge of the hole in the magnet as at 32 will be increased.

It is pointed out that the bottom or rear end plate 26 tapers and thins upwardly and radially outwardly along an irregularly curved surface as at 34. Theoretically, a central slug incorporated within the end plate has a cylindrical outer area equal to the area of the end of the cylindrical pole piece. An annular radially facing surface is thus presented to accept all lines of flux from the center pole piece, without any increase or reluctance to flow of the flux. As the path of radial flow of the flux lines increases radially outwardly from the theoretical central diameter of the pole piece, the available area within the end plate increases in proportion to the increased diameter. The thickness of the plate can thus be decreased proportionally without any restriction or adverse concentration of the flux. As the end plate reaches the outer periphery of the magnet (which is the source of the flux) the thickness of end plate required to pick up and transmit the last increment of flux reaches a theorectical zero.

A similar or reverse situation exists in the top plate 30 which tapers in thickness along an irregularly curved line as at 36. Some deviation from the theoretically perfect taper may of course be made to provide for the mechanical shaping of the radius in the basket leading to the eyelet 22.

It will be apparent that well over half of the material in prior end plates of uniform thickness is eliminated by the construction shown. The savings in weight and material costs are significant. It will also be noted that significant savings can be accomplished by utilizing only part of those which are theoretically available. Thus the radially inner edge of the curves 34 and 36 may terminate somewhat further out from the positions shown. Also, the peripheral edges need not taper to absolute zero thickness, if it is more mechanically feasible to leave a measurable thickness at that point.

The foregoing description generally contemplates a turning or machining of the tapered surfaces 34 and 36 on the end plates, but this and the related expense is not necessary.

Other methods of forming the end plates can be utilized to contribute to the overall reduction in cost of the assembly. The end plates can be press molded to size from powdered iron and sintered, thus eliminating machining cost and waste. The end plates can alternatively be assembled from separate stamped segments as shown in FIGS. 3 to 6.

Figure 3:
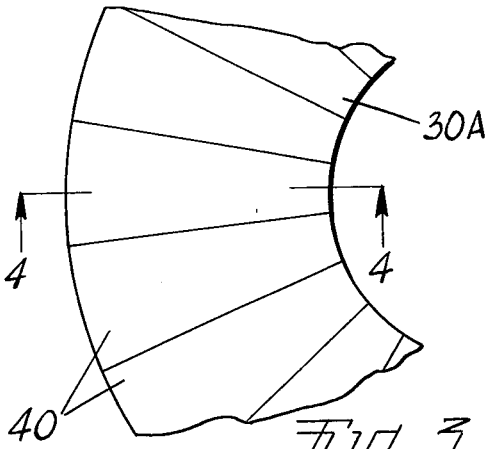
FIG. 3 is a fragmentary front or top plan view of a modified front end plate.
Figure 5:
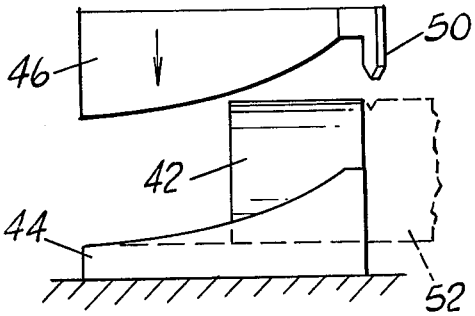
FIG. 5 is a side elevational view of a set of dies for forming the segments of the end plate in FIGS. 3 and 4.
Figure 6:
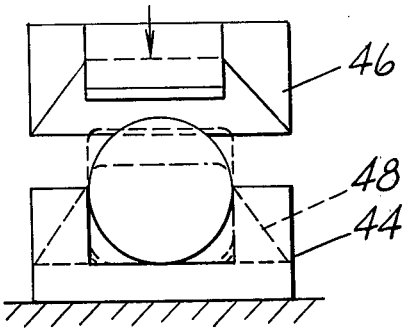
FIG. 6 is an end elevational view of the dies and work slug in FIG. 5.

The modified outer end plate 30A shown in FIG. 3 is made up of plural segments 40 which may be secured together by adhesive along their radial edges or secured individually to the face of the magnet, or both. The tapered and flared segments are formed by stamping or cold forging a slug 42 of inexpensive drawn iron wire between a lower die 44 and an upper die 46. The lower die 44 has a wedge shaped recess 48 into which the cylindrical shape of the slug is progressively deformed by the dies. A cut-off knife or jaw 50 on the upper die acts to separate the slug from bar stock indicated at 52 and hold the slug axially in place as it is shaped. It is an inherent feature of the method of manufacture that the molecular structure of the drawn slug is generally axially aligned, and this alignment is maintained in the segments 40. This is desirable as it improves the magnetic conductivity along the desired lines of flux.

Figure 7:
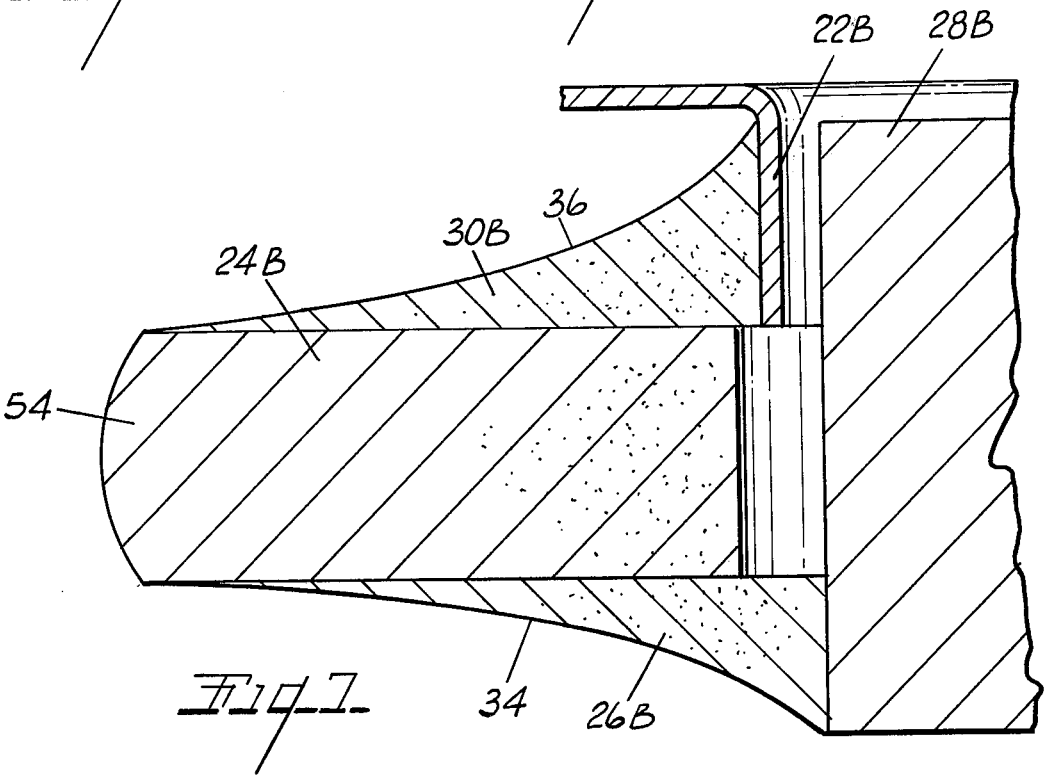
FIG. 7 is an enlarged fragmentary radial and axial cross sectional view through a molded modification of the magnet assembly.

A highly desirable form of the magnet assembly is shown in FIG. 7 in which the magnet 24B is molded with a slight peripheral radius 54 to both improve its appearance and to increase the length of the path of leakage flux between its faces. The end plates 26B and 30B are molded from powdered iron with suitable binder or sintering, and have surface radii 34 and 36 at their outer surfaces to reduce the amount of material in the plates and increase their efficiency just as in FIG. 1. The plate 26B is apertured in the center to receive the rear end of the pole piece 28B with a press fit. The eyelet 22B of the basket is press fitted in the hole in the front end plate.

Besides the immediate saving of between 60 to 65 percent of the end plates 24 and 36 in all modifications, the assembly produces an additional advantage of reducing the stray flux which is invariably lost in passing between the radially outer edges of the oppositely polarized faces of the magnet as is indicated by the dotted line at 56 in FIG. 1. By extending the outer edges of the end plates approximately to the outer edges of the magnet, nearly all flux emanating from the magnet faces is channeled into the end plates, and by tapering or beveling the edges of the end plates sharply away, the reluctance of the air gap of the leakage flux is rapidly increased.

Where prior magnet structures of this general type purposely terminated the outer edges of the end plates radially inwardly from the outer edge of the magnet by as much as one-eighth to one-quarter of an inch, to reduce leakage between the exposed edge poles on the plates, the present structure covers substantially the entire end pole faces of the magnet. This permits the outer diameter of the magnet to be reduced. Since the ceramic magnetic material is relatively expensive, this saving in volume where the diameter is greatest is substantial from a cost standpoint, as well as a weight standpoint. A reduction of 17 to 18 percent in the magnet weight, along with the reduction of the end plates, for an over-all weight reduction of 48.5 percent has been measured, using the same pole piece as a fixed factor.

Not only are the savings in materials substantial, there is also an improvement in performance. It has been shown that starting with a prior magnet assembly of given voice coil diameter and a seven and one-half inch diameter magnet of given axial length, tapering the end plates as shown showed a 4.8 percent improvement or increase in the flux density in the voice coil gap, and a 5 percent reduction in the stray or lost flux field around the edge of the magnet structure. Reducing the diameter of the end plates slightly inside of the periphery of the magnet does not materially change the over-all concentration of flux in the voice coil gap.

The theoretically ultimate shape of the curved surfaces of the end plates is to provide a constant flux density radially inwardly to the pole piece 28 or 28B, or to outer surface of the voice coil gap as defined by the eyelets 22, 22B or the inner surface of the top end plate, if no eyelet is used. The bottom or rear end plate is designed to carry all of the flux transmitted by the cylindrical pole piece, which is in turn designed to make full use of the magnet 24.

Particularly at the rear end plate, the thickness of the plate at the circumference of the pole piece should provide an internal cylindrical area equal to the cross sectional area of the pole piece. This of course is a design factor depending upon the desired characteristics of the finished speaker. As the radius of the end plate increases outwardly from the pole piece, the thickness of the plate may be reduced and still provide the same flux transmitting area. The rate of reduction in thickness is calculatable as a first exponential curve from the surface of the pole piece to the inside radius of the magnet.

As the end plate extends outwardly over the magnet another factor enters into the calculation of the curve of the surface. In addition to the decrease of thickness due to increased radius, there will be a further decrease in required thickness to maintain equal flux density, due to the decrease of available flux at radially outwardly displaced positions in the plate and the magnet. In other words, at any given radius along the magnet, that portion of the flux generated by the radially inward portion of the magnet has already been accommodated, by the thicker inward portion of the plate so the plate may be further reduced in thickness and still accommodate the remaining available flux in the outer portion of the magnet, at the same flux density. A second exponential curve for the surface of the end plate as it extends across the magnet can be mathematically calculated.

Similar curves can be calculated and generated for the outer surface of the top plate, bearing in mind that the cylindrical pole face for transmitting the desired flux is located at the outer side of the voice coil gap, in radially spaced relation to the side of the outer end of the pole piece. Other design factors such as the presence or absence of an eyelet 22, and a possible desire to axially expand or contract the flux in the voice coil gap may have to be taken into account.

As to both end plates, a further factor representing the relative magnetic conductivity of the material of the end plates as compared to the material of the central pole piece may have to be introduced into the calculations.

The calculations of a theoretically perfect end plate are involved, and are not reproduced herein as it is not necessary to reduce the plates to such a degree of perfection in order to achieve the great majority of the advantages of the invention. The invention lies in materially reducing the axial thickness of the radially outer portions of the end plates; and also in bringing the thin outer edges of the end plates into close proximity to the periphery of the magnet, either by reducing the diameter of the magnet or increasing the diameter of the end plates as desired. As an arbitrary minimum or limit to the invention as pertains to the tapered shape of the end plates, any reduction in radially and axially outside corner of the end plate or plates which amounts to more than 50 percent of a corresponding plate of rectangular cross section is considered as obtaining substantial amounts of the benefits of the invention as defined in the following claims.

What is claimed as new is:

1. A magnet assembly for a permanent magnet dynamic transducer having a coil axially reciprocable in a narrow annular gap between a central straight cylindrical pole piece of magnetically conductive material and a surrounding first end plate of magnetically conductive material, the magnetic circuit of said gap being completed by a flat annular permanent magnet surrounding said pole piece in radially spaced relation thereto and being in lapped relation to said first end plate, and a second end plate of magnetically conductive material lapped against the opposite end of said magnet and extending radially inwardly of the interior surface of the magnet into magnetically conductive contact with the opposite end of said pole piece from said gap, said end plates being characterized by axially exterior ends that taper from thin peripherial edges in lapped relation adjacent to the peripherial edges of the ends of said magnet with the plates increasing in axial thickness in concavely curved surfaces radially inwardly to annular portions of maximum thickness located radially inwardly of the radially inner surface of said annular magnet, the tapers on said end plates being such as to produce cross sectional areas in each plate taken radially and axially of the tapers which are less than 50 percent of similar cross sectional areas of untapered plates having the same maximum axial and radial dimensions.

2. A magnet assembly as defined in claim 1 in which said concavely curved surfaces of said end plates decrease in thickness from their inner portions of maximum thickness along curves determined by a first factor of the increasing radius of the plate as that factor requires less thickness to provide equal annular internal area, and as further modified and reduced across said magnet by a second factor of the increasing radius across said magnet as that factor reflects a decrease in available flux in that portion of the magnet remaining outside of the thicker portions of the plates.

3. A magnet assembly as defined in claim 1 in which at least one of said end plates is formed of lengths of iron wire deformed into mating tapered segments arranged in contacting side by side relation.

* * * * *